United States Patent [19]

Ottaway

[11] 4,007,926

[45] Feb. 15, 1977

[54] MOBILE AMUSEMENT RIDE

[76] Inventor: Herbert J. Ottaway, 3702 Elmwood Drive, Wichita, Kans. 67218

[22] Filed: Sept. 23, 1974

[21] Appl. No.: 508,160

[52] U.S. Cl. ..... 272/37; 272/29; 272/38; 272/50; 272/51

[51] Int. Cl.[2] ..... A63G 1/40; A63G 1/10

[58] Field of Search ..... 272/29, 50, 36, 31 R, 272/31 A, 37, 38, 51, 40, 41

[56] References Cited

UNITED STATES PATENTS

| | | | |
|---|---|---|---|
| 419,490 | 1/1890 | Barratt et al. | 272/50 |
| 660,168 | 10/1900 | Schmitt | 272/50 |
| 935,239 | 9/1909 | Schmidt | 272/36 |
| 1,037,453 | 9/1912 | De Vito | 272/50 |
| 1,465,012 | 8/1923 | Kohler | 272/50 |
| 1,559,476 | 10/1925 | Troike | 272/50 |
| 2,728,574 | 12/1955 | Lyles | 272/38 |
| 2,816,763 | 12/1957 | Lyles | 272/38 |
| 2,828,128 | 3/1958 | Castille | 272/50 X |
| 3,243,184 | 3/1966 | Robinson et al. | 272/50 X |
| 3,787,046 | 1/1974 | Clem | 272/29 |
| 3,840,225 | 10/1974 | Fouche | 272/29 |

FOREIGN PATENTS OR APPLICATIONS

| | | | |
|---|---|---|---|
| 687,617 | 4/1930 | France | 272/50 |

*Primary Examiner*—Anton O. Oechsle
*Assistant Examiner*—Arnold W. Kramer
*Attorney, Agent, or Firm*—Robert E. Breidenthal

[57] ABSTRACT

An amusement ride, which can be transported in a collapsed condition on the truck bed that supports the same during use; such ride employing a main drive motor, which is mounted in a gimbal fashion at the top of a vertical support column, that centrally supports and drives a great wheel that partakes in the gimbal motions of the drive motor. A gimbal drive motor is also mounted adjacent the top of the column and serves to cause a gimbal movement of the main drive motor so that axis of the great wheel describes a conical surface in space and moves between a horizontal and vertical position with the great wheel being above the top of the column in the latter position. Passenger seats are pivotally supported from the periphery of the great wheel in such a manner that they are above the great wheel when the axis of the latter is vertical.

6 Claims, 16 Drawing Figures

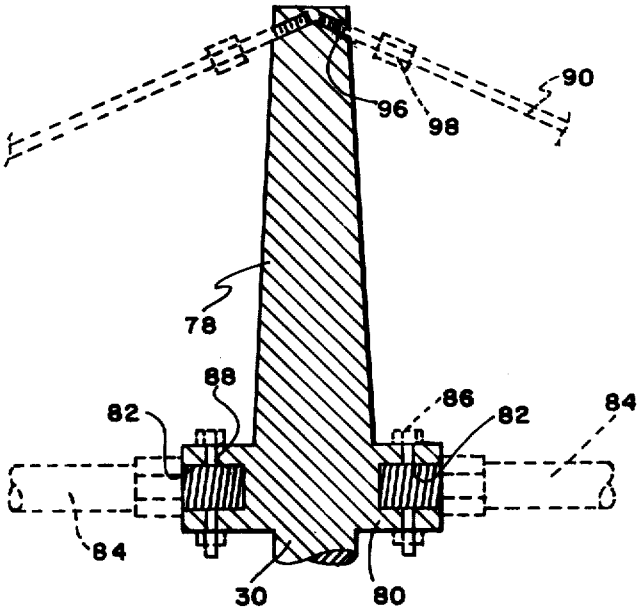
FIG. 8
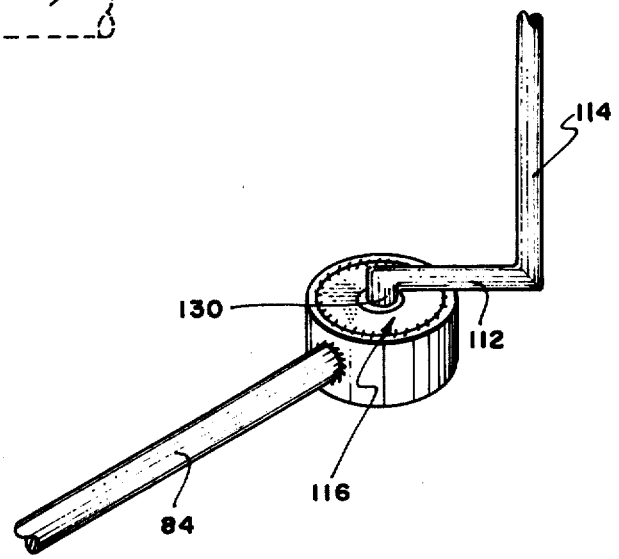
FIG. 9
FIG. 10
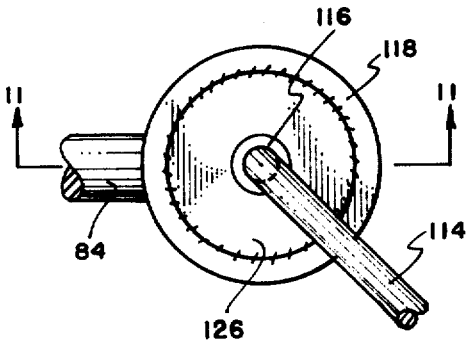
FIG. 11
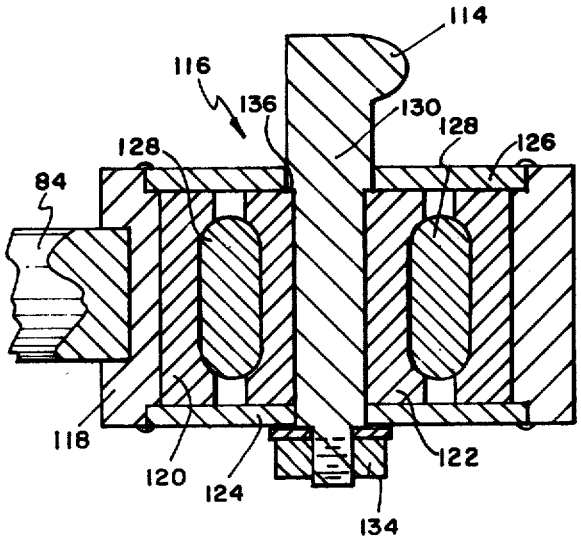

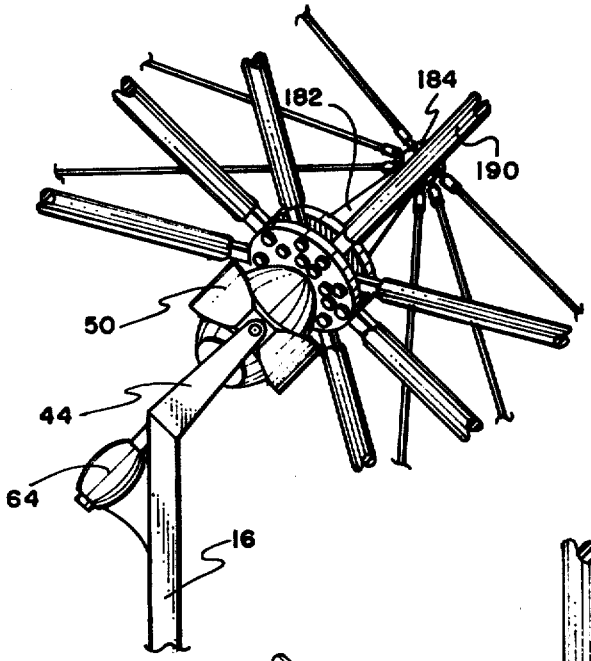
FIG. 12
FIG. 13
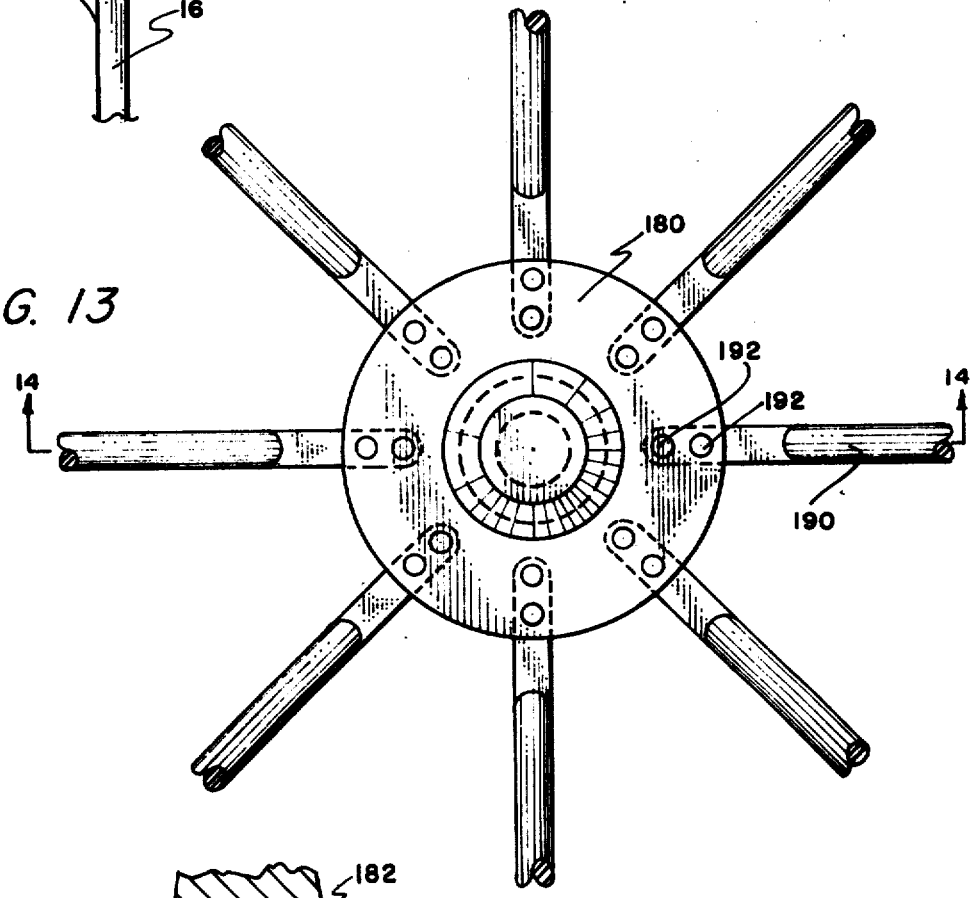
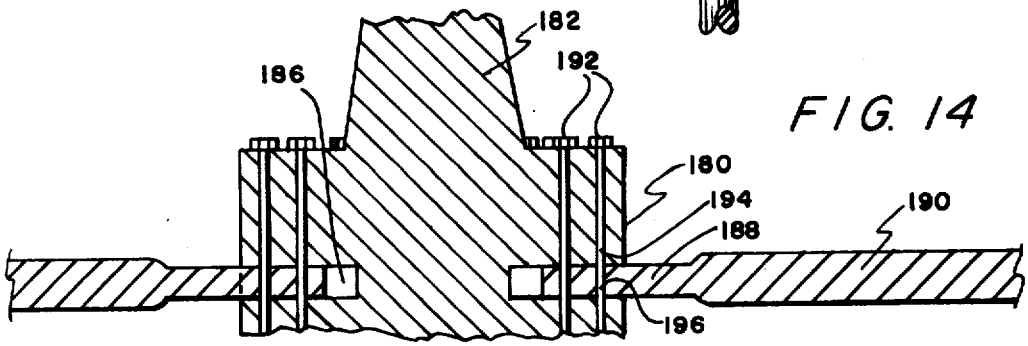
FIG. 14

MOBILE AMUSEMENT RIDE

The present invention pertains to an amusement ride of the giant wheel type that is customarily commercially operated at amusement parks, and at fairs and carnivals, and more particularly relates to new and useful improvements in such rides having to do with the portability thereof, the imparting of tilting movements of the wheel axis in both the vertical planes, and to the provision of non-upsetting passenger seating means compatible with the rotating and tilting motions of the giant wheel supporting the same.

The primary object of the invention is to provide an amusement ride affording unique and amusing motions to riders thereof in a safe manner.

Another important object is to provide a ride in accordance with the preceding object that can be readily changed from a transport condition to an operating condition, and vice versa, on a transport vehicle, whereby the time interval between closing operations at one location and resuming operations at a remote location can be minimized.

Still another object is to provide with maximum economy a durable and safe amusement ride that requires a minimum of skill and training on the part of those operating the ride as well as by those concerned with readying the ride for operation.

Broadly, the invention comprises means supporting a rotatable giant wheel in such a manner that a freedom of angular position for the wheel rotation axis is afforded, together with powered means for moving the wheel axis through a predetermined sequence of angular attitudes and means for supporting passenger seats from the wheel in such a manner as not to upset a passenger therefrom.

The invention will be best appreciated in the light of the following description of preferred embodiments thereof, such description being given in conjunction with the accompanying drawings illustrative thereof wherein:

FIG. 8 is a sectional detail view taken on an enlarged scale of the wheel hub, the view being taken on the plane of the section line 8—8 in FIG. 7 with braces and spokes being shown in dashed outline;

FIG. 9 is a fragmentary isometric view of the outer end portion of one of the spokes and shows its pivotal connection to a partially shown seat mounting arm;

FIG. 10 is an enlarged detail view of the pivot shown in FIG. 9;

FIG. 11 is an enlarged sectional detail view of the pivot shown in FIG. 10, the view being taken on the plane of the section line 11—11 in FIG. 10;

Figure 1:
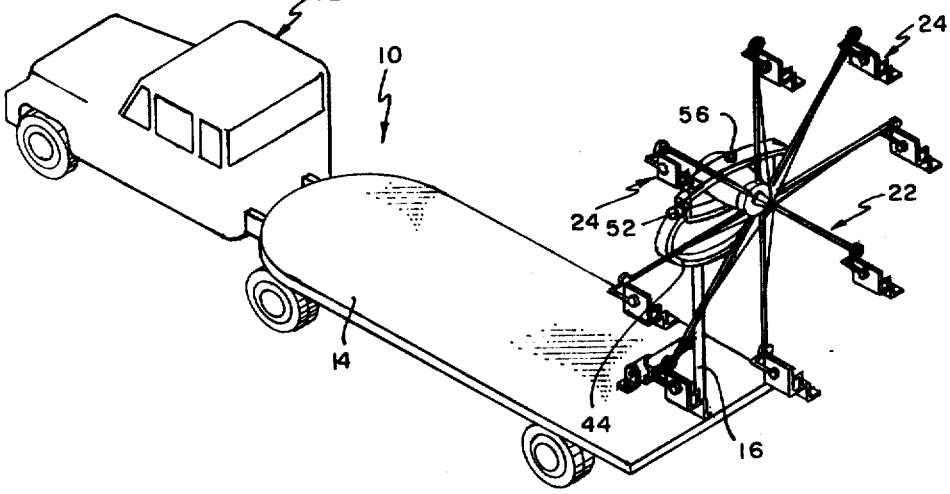
FIG. 1 is an isometric view of the amusement ride on a reduced scale showing the same in its erected and operative position with the wheel being disposed with the axis thereof so that passengers can be loaded and unloaded.
Figure 2:
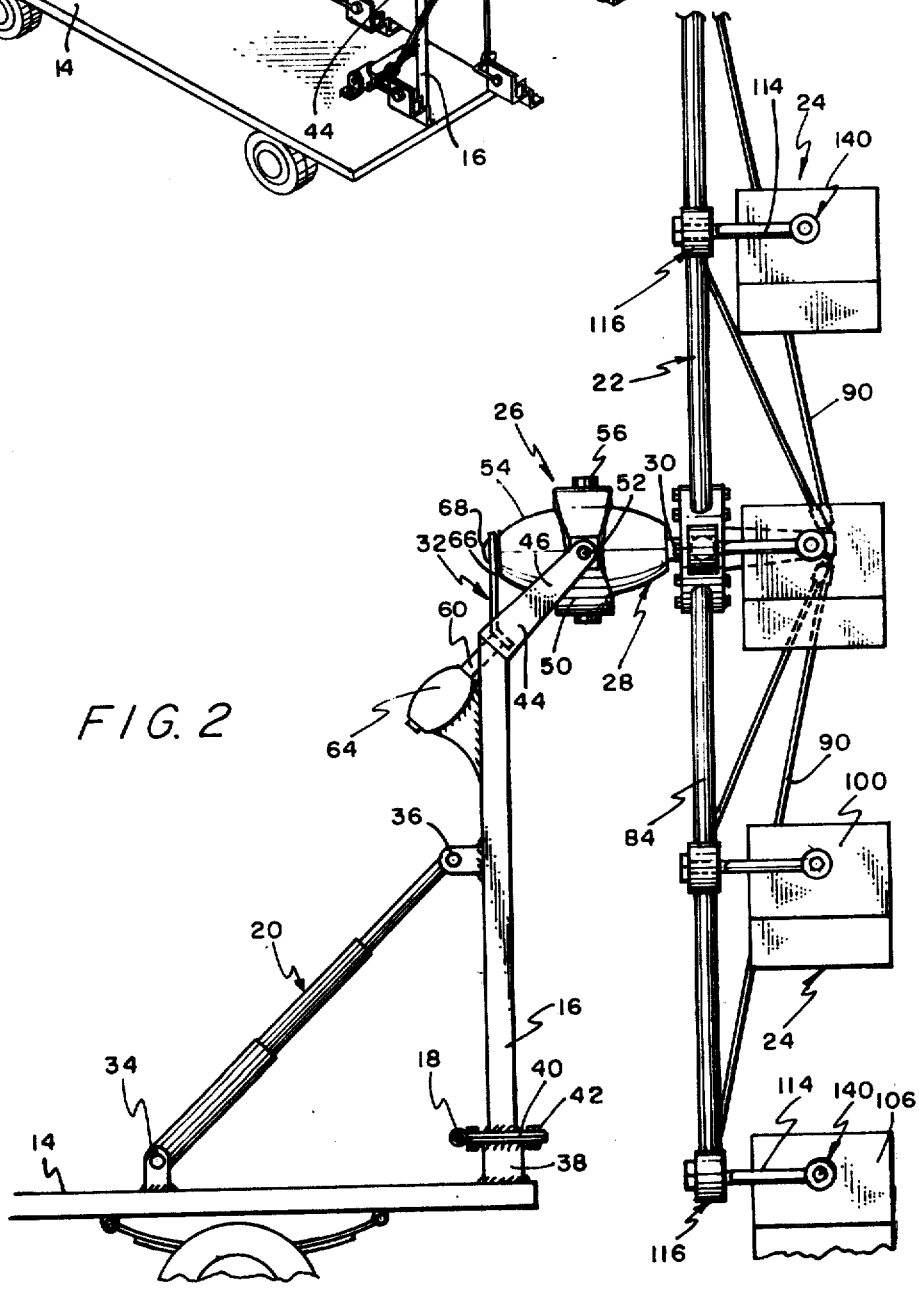
FIG. 2 is a fragmentary side elevational view on an enlarged scale of the apparatus shown in FIG. 1.
Figure 3:
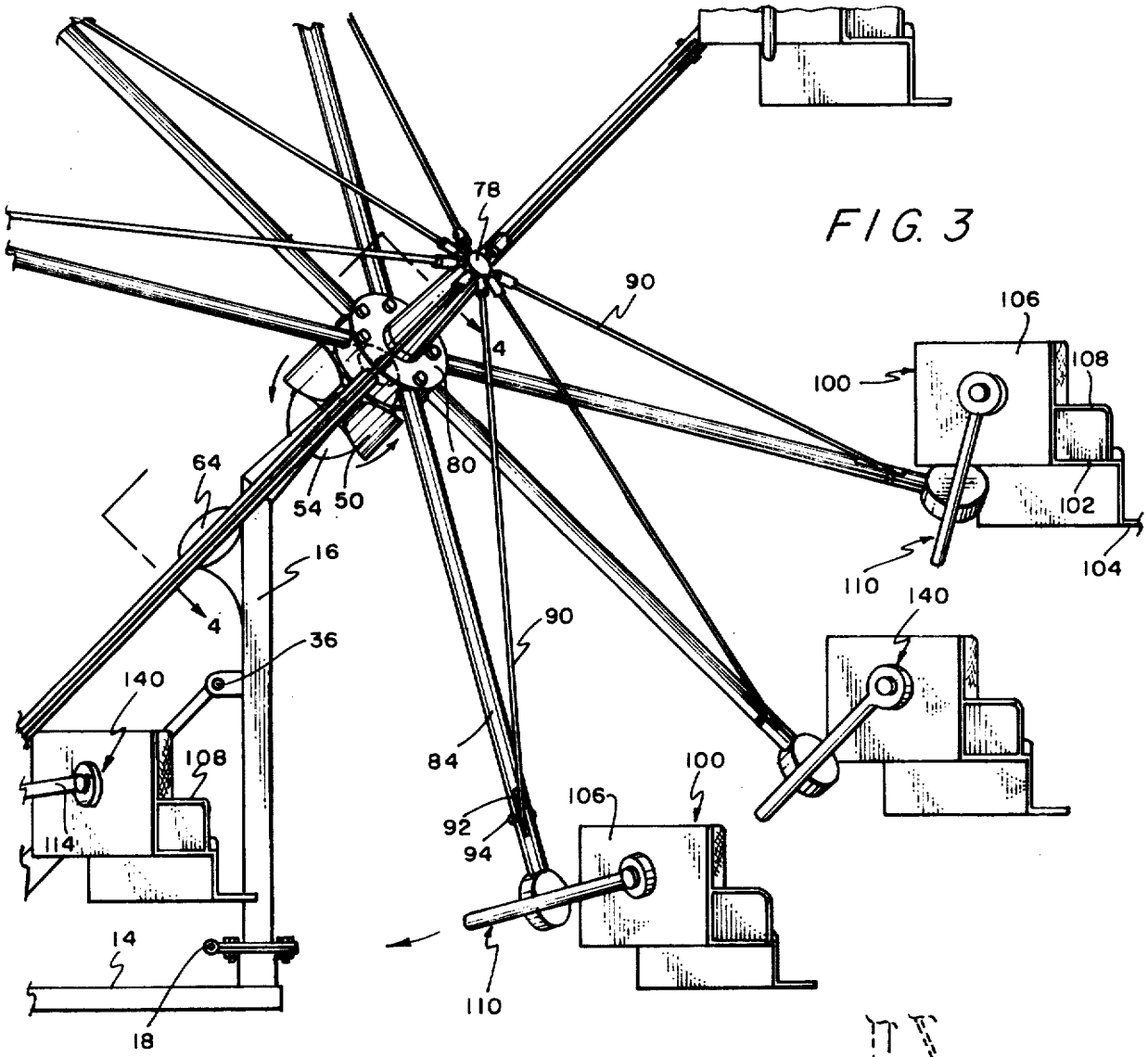
FIG. 3 is a view generally similar to FIG. 2 showing the axis of the wheel having been displaced from the horizontal.
Figure 4:
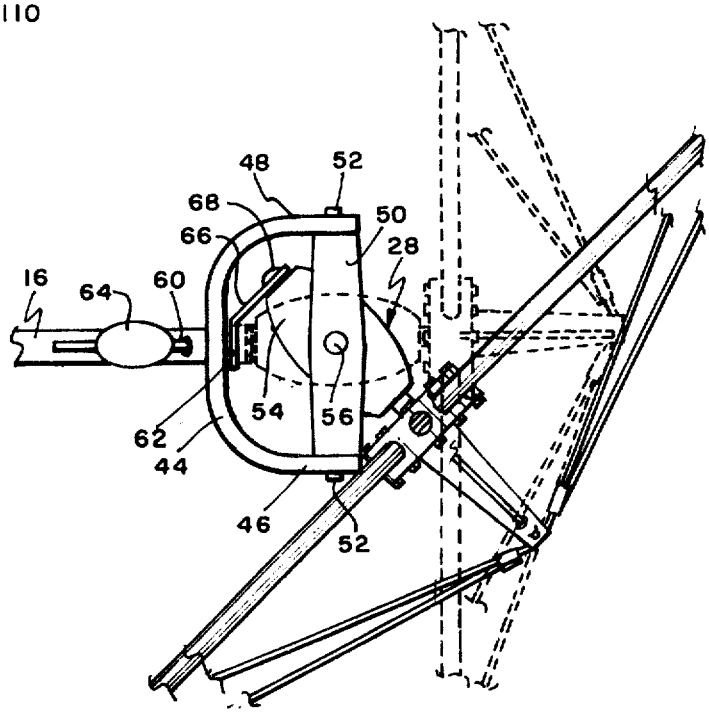
FIG. 4 is an enlarged fragmentary view of the gimbal-type mounting of the wheel, the view being taken from the plane of the line 4—4 in FIG. 3 and with an alternate position of the central portion of the wheel being shown in dotted outline.
Figure 5:
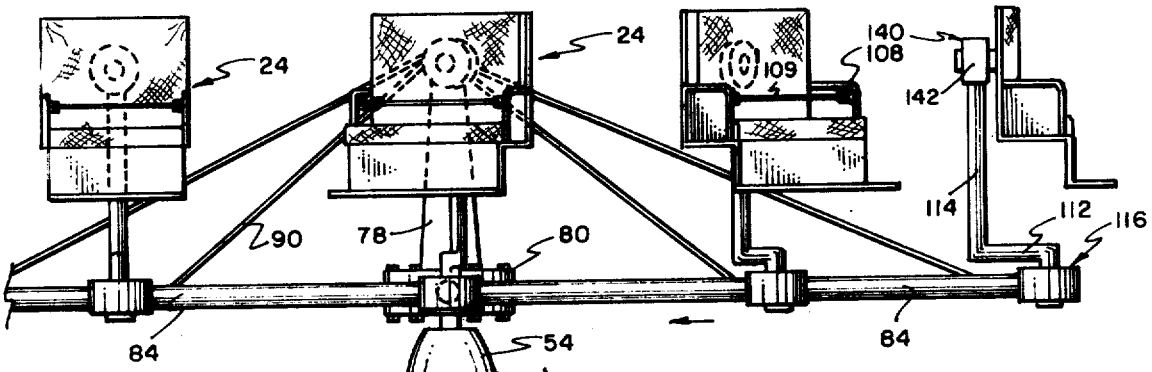
FIG. 5 is a fragmentary view generally similar to FIG. 3 and showing the wheel with its axis vertical.
Figure 6:
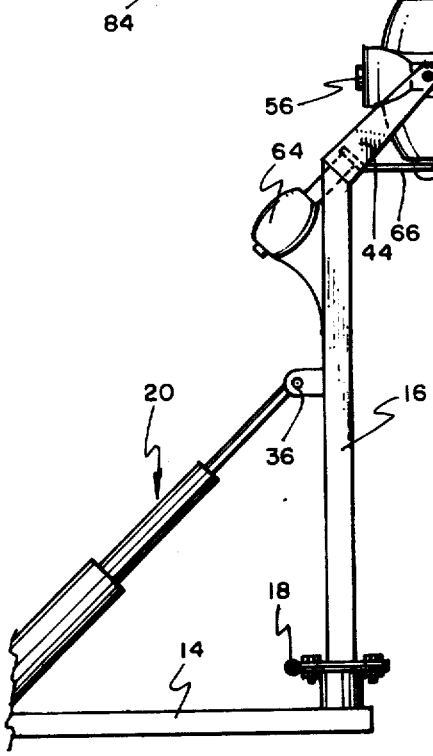
FIG. 6 is another framentary view similar to FIG. 3 showing the wheel axis in another attitude.
Figure 7:
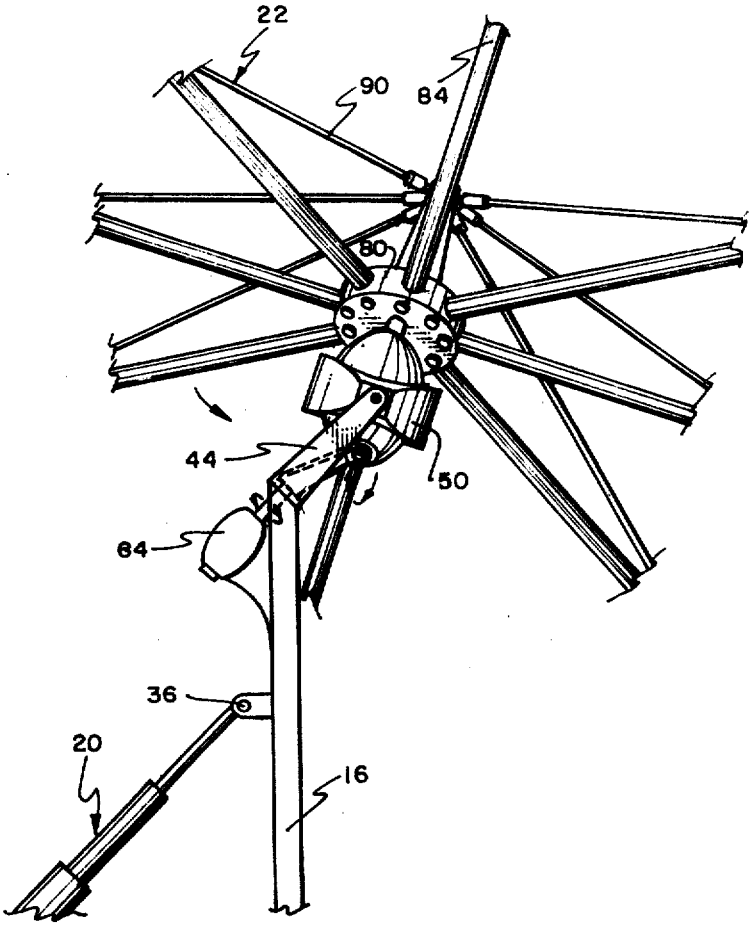
FIG. 7 is an end view of the wheel hub with hidden spoke sockets being shown in dashed outline.
Figure 7:
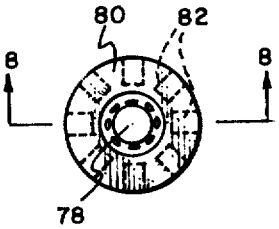
Figure 15:
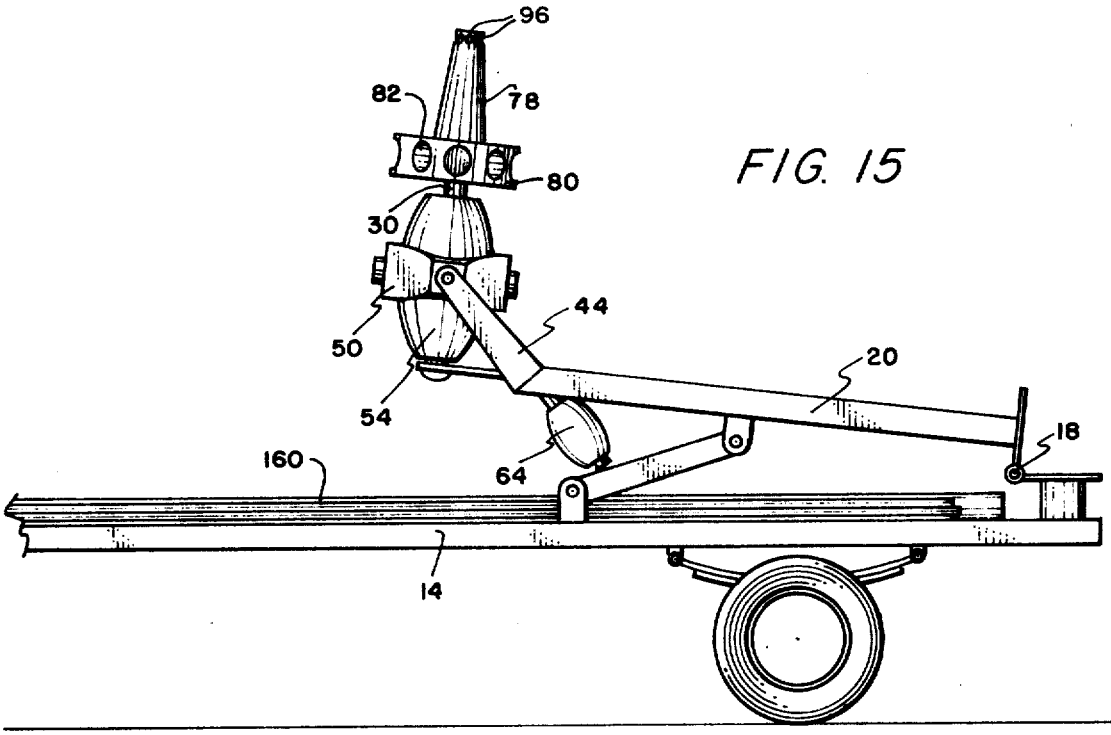
Figure 16:
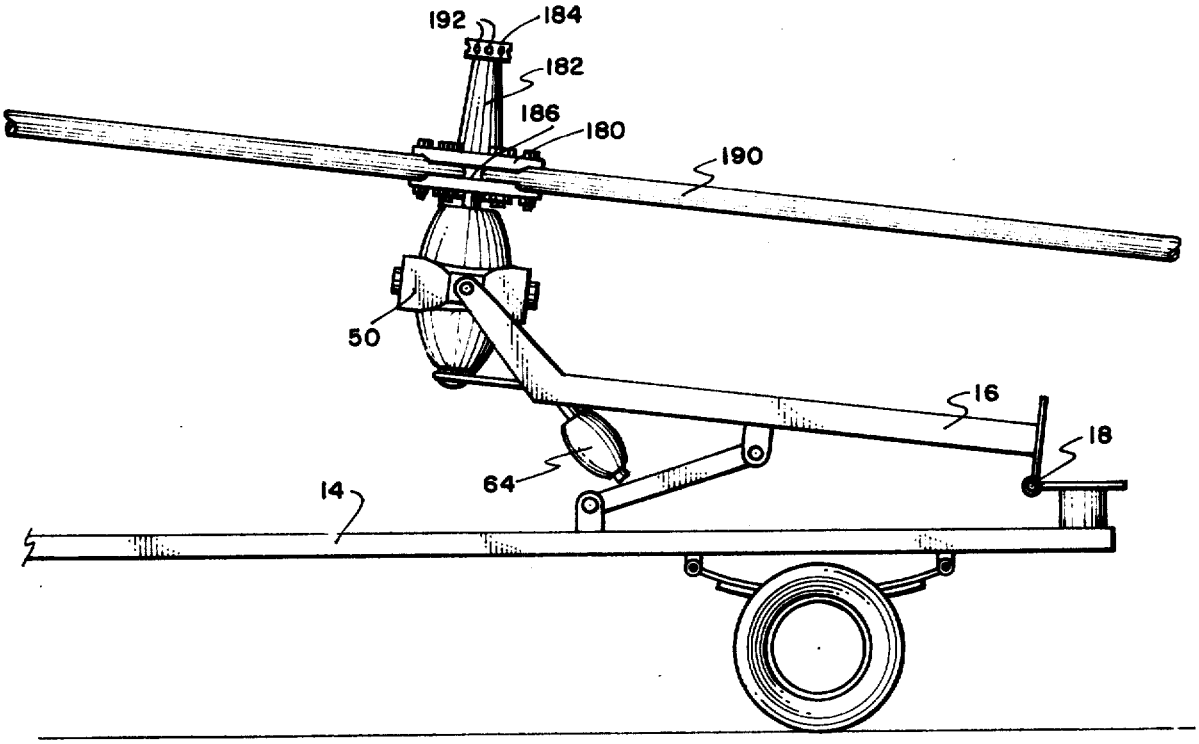

FIGS. 12, 13 and 14 pertain to a modified wheel hub structure with FIG. 12 being a fragmentary isometric view of the modified hub and its associated spokes and braces;

FIG. 13 is an enlarged fragmentary end view of the modified hub structure, with hidden details being shown in dashed outline;

FIG. 14 is a sectional detail view of the modified hub, the view being taken on the plane of the section line 14—14 in FIG. 13;

FIG. 15 is a fragmentary side view illustration of the apparatus of FIG. 1 shown collapsed into transport condition with the spokes and braces being stowed on the truck bed and the seats removed; and, FIG. 16 is a view generally similar to FIG. 15, however, this view shows the modified hub of FIGS. 12 and 14 and shows the apparatus partially assembled preparatory to erection for ride operation.

Referring now to the drawings and initially directing attention to the embodiment shown in FIGS. 1–11 and 15, the reference numeral 10 designated the amusement ride generally inclusive of a self propelled transport vehicle 12 having an elevated and elongated horizontal flat bed 14, an elongated steel support column 16 pivotally mounted at 18 to the bed 14 adjacent rear end of the latter for movement between its generally horizontal transport condition shown in FIG. 15 to its erect operative position shown in FIG. 1. The pivotal movement of the support column 16 is about a horizontal axis that is transverse to the longitudinal extent of the vehicle 12 and under the control of a power means preferably in the form of conventional telescopingly extensible hydraulic means 20, as shown.

The amusement ride 10 also includes a giant wheel 22 (of metal construction, preferably of steel or aluminum) that supports a plurality of passenger units 24 at peripherally spaced positions. As will be noted, the term "wheel" is used in a broad sense in that while the same has a generally round configuration of substantially greater radial extent than of axial extent, the term as used does not imply any necessity for peripheral rim of either circular or regular polygon configuration. It will be understood that a rim could be included if desired for bracing or the mounting of lighting devices and so forth, but the same is not essential, especially since the the wheel 22 is driven in rotation from its center rather than by means engaging the periphery as is commonly the case with rides of the roundabout or giant wheel type.

The giant wheel 22 is centrally supported upon the upper end of the support column 16 by a gimbal means of steel construction designated generally at 26; the latter being associated with a power means 28 that affords a rotary mounting for and drives in rotation the steel axle or spindle 30 fixed to the wheel 22, the with powered means 32 of steel construction for tilting the wheel axle 30 in a prescribed manner.

The gimbal means 26 and the tilting means 32 enable the wheel 22 to be moved to various positions such that its axle 30 or axis of rotation can, for example, be horizontal so that wheel rotation causes the seating units 24 to move along paths analogous to those of a Ferris wheel, can be vertical so that the paths are circular in an elevated horizontal plane such that the seating units are disposed above all other parts of the ride 10.

Although the hydraulic means 20, which is pivotally connected to bed 14 at 34 and to the support column 16 at 36 can hold the support column 16 vertical during operation of the ride, means is provided to positively secure the support 16 in its vertical position, such means comprising the pivot means 18 being carried on the upper front side of a flanged steel base 38 fixed to the rear end of the bed 14, the arrangement being such that the flanged lower end of the support 16 rests on the base 16 is vertical. Nut and bolt means 42 are provided to releasably secure the flanged position of the base 38 and of the support 16. It will be convenient to observe at this time that the center of gravity of the support 16 and all that the latter carries is such as to urge the support 16 clockwise as viewed in FIG. 2 when the support 16 is vertical. This contributes (rather than detracts) to the stability of the support 16 in its vertical position totally apart from the hydraulic means 20 and the fastening means 42.

Conventional means, not shown, can be employed to stabilize the bed 14, such as hydraulically operated outriggers, and guys can be attached from the support 16 to the bed 14 or other suitable anchoring points.

The gimbal means 26 comprises a large steel yoke or U-shaped member 44 that is fixedly secured as by welding to the upper end of the support 16. The yoke 44 is symmetrical with respect to the central vertical medial plane of the ride 10 and longitudinally bisects the hydraulic means 20 and the support 16. The yoke 44 is inclined upwardly and rearwardly at an angle of 45° for a reason presently to be made clear.

The yoke 44 constitutes an open frame and includes spaced legs 46 and 48. An open steel subframe 50 is disposed between the legs 46 and 48 and is rotatably secured to the yoke 44 by means of oppositely extending trunnions 52 journaled in the legs 46 and 48. The arrangement is such that the subframe 50 can oscillate about an elevated horizontal transverse axis.

The power means 28 which includes a housing 54 is disposed within the open subframe 50 and is oscillatably supported therein by having oppositely extending trunnions 56 on the housing 54 journaled in opposed portions of the subframe along an axis that is perpendicular to the intersects the axis defined by the trunnions 52 midway between the legs 46 and 48.

The power means 28 includes within its housing 54 a prime mover, preferably an electric motor and reduction gearing, not shown, drivingly connected to the axle 30 of the wheel 22. The axis of rotation of the axle 30 and of the wheel 22 intersects the intersection of the axes of the pairs of trunnions 52 and 56 and the axis of the wheel 22 is also perpendicular to the axis defined by the trunnions 56.

The gimbal mounting means 26 constituted of the yoke, trunnions 52, subframe 50, trunnions 56 and the housing 54 affords a substantial degree of freedom of tilting movement for the axis of rotation of the wheel 22.

Those conversant with the art will recognize that rotation of the wheel 22 about its axis while concurrently tilting the axis of the wheel enables imparting an extraordinary motion to a rider that includes a breathtakingly degree of unpredictability relatively lacking in other roundabouts operating at about the same speed. In the development of the present invention it has been found that imparting a simple predetermined program of tilting movement to the wheel axis 30 is quite effective, very simple to execute and particularly compatible with positioning the passenger units 24 into loading and unloading position. Such means 32 alluded to previously comprises a shaft 60 coincident with the axis of symmetry of the yoke 44 rotatably journaled through the bight or center of the yoke 44 to have one end 62 positioned within the yoke 44 and its other operatively connected to a prime mover 64 mounted on the support 16 on the side opposite that from which the yoke 44 extends.

The prime mover 64 is of a type having a slow speed high torque and can conveniently be an electric or hydraulic motor with reduction gearing.

The shaft 60 is of course inclined upwardly 45° as is the yoke 44, and its axis is such as to intersect with the intersection of the axes of the trunnions 52 and 56 and the wheel axis 30.

The shaft 60 has fixed to its end 62 a radially extending arm 66 and the radially outermost end of the arm 66 has pivotal connection to the prime mover housing 54 at 68 about an axis in alignment with the axle 30. If desired or deemed convenient, the axle 30 can be journaled entirely through the housing 54 and the arm 66 rotatably secured directly thereto. The arrangement is preferably such that the axes of the shaft 60 and the axle are inclined to each other 45°, whereby when the arm 66 has its maximum upward and downward departures the axis of the wheel 22 is repectively horizontal and vertical. Incidentally also, when the axis of the wheel 22 is horizontal, it is also in alignment with the longitudinal extent of the vehicle 12, that is, it is in the position shown in FIG. 1 such that the same can be loaded and unloaded from loading platform, not shown, or fixed azimuth.

The tilting path of the wheel axis prescribed by the described structure is such that the axis describes the surface of a cone that has an apical angle of 90°, with the arm 66 constraining the axis to a fixed angular departure from a given direction.

The powered tilting means 32 is operable independently of the operation of the power means 28, and the tilting means can be operated with conventional control means well known to those skilled in the art to move in one direction or reversely, motion being continuous or intermittent. The power means 32 serves to prevent rotation of the shaft 60 when the ride is being loaded or unloaded. In use of the ride 10, it is often desirable to hold the wheel axis vertical for a period of time and, of course, the conventional means 32 enables such function.

As mentioned above the two powered means 28 and 32 are independently operable, and one can be driven in any desired manner while the other is stopped or driven in any desired manner. The power means 28 is shown as being larger than the means 32 and this is for the reason that the former in the usual operation of the ride 10 must develop more power for the reason that it must quickly start and stop the wheel 22 in rotation such as in incrementally advancing the same for loading and unloading adjacent passenger units 24. Then, too, not only does the wheel 22 usually require greater acceleration, its moment of inertia is higher, and additionally the rotational speed of the axle 30 usually is caused to be greater than that of the shaft 60.

The wheel 22 comprises the axle 30 and an integral tapered spindle-like axial extension 78 thereof, with such structure including a radially extending integral hub 80. The hub 80 is provided with a plurality of internally threaded sockets 82 which threadingly accommodate the inner ends of a plurality of indentically radially extending spokes 84. Nut and bolt means 86 are provided to prevent inadvertent disengagement of the spokes 84 from the hub 80, the bolts of such means extending through aligned openings 88 in the hub 80 and the spokes 84 when the latter are fully threaded into the sockets 82.

Each spoke 84 is provided with a brace rod 90 that connects between such spoke and the spindle adjacent the free end of the latter. As may be seen in FIGS. 3 and 8, the radially outer end of the brace rod 90 is received in a slot 92 in the spoke 84, and is detachably retained therein by a nut and bolt means 94 that extend through the spoke 84 and an eye, not shown, in the portion of the rod 90 within the slot 92. The other end of the brace rod 90 is threadingly received in a socket 96 in the spindle 78. The rod 90 is two-piece construction joined by a rotary connecting element 98 that enables the rod to be threaded into the socket 96.

When the spokes 84 and the brace rods 90 are properly assembled and tensioned, the wheel 22 is quite adequate in strength for its intended use even with no structural elements joining the outer extremities of the spokes 84. As mentioned previously bracing or tension elements can be provided to connect the outer ends of adjacent spokes 84, such tend to increase the moment of inertia of the wheel 22 and its driving requirements. Such increase in wheel driving capability can be easily effected if deemed desirable or expedient. An advantage occurs on the omission of connecting elements in that passengers will have an enhanced sense of freedom and aloneness in space as the space about each of the passenger units 24 is relatively uncluttered.

Should the provision of bracing or tension elements connecting the outer ends of adjacent spokes be deemed expedient or desirable, the provision of the illustrated and described brace rods can be omitted, and indeed the latter can be omitted if desired whether or not the outer ends of the spokes are connected by peripheral wheel elements.

Each passenger unit 24 comprises a chairlike structure 100 including a seat 102, a foot rest 104 and a back 106. The chair 100 can have a width suitable for one or more passengers as may be desired, and the chair 100 also includes side arm rests 108 to prevent a passenger from falling off a seat sideways, and in addition, the chair includes conventional seat belts or operator latched passenger securing bars 109, which can be in the nature of such safety devices commonly employed in connection with the chairs of Ferris wheels.

Each passenger unit 24 also includes means 110 for supporting the chair 100 from the outer end of a spoke 84 in such a manner that the chair 100 will not depart sufficiently from an erect position as to upset passengers. Such means 110 comprises an L-shaped arm comprises of integral legs 112 and 114 that join at right angles. The free end of the relatively shorter leg 112 is pivotally secured to the free end of the spoke 84 by pivot means 116 having an axis parallel to the wheel axle 30. The leg 112 is perpendicular to the axis of the pivot means 116 and so that the leg 114 is parallel to the axes of the pivot means 116 and the wheel axle 30. The pivot means 116 is closely adjacent the leg 114 so that the latter swings in closely spaced proximity to the radial extent of the spoke 84 during pivotal movement.

The pivot means 116 is of the antifriction type and comprises a bearing housing 118 rigidly fixed to the outer end of the spoke 84, and inner and outer roller bearing races 120 and 122 are confined within the housing by end plates 124 and 126 suitably secured to the housing 118, with antifriction rollers 128 interposed between the races 120 and 122. An integral lateral extension 130 of the leg 112 extends into the hollow interior of the inner race 122 and is detachably retained therein by a washer and a nut 134 threaded on the extension, with a shoulder 136 on the extension bearing against the inner race 122 at the side of the latter opposite the nut 134. Cotter pin means, not shown, is provided to prevent inadvertent dislodgment of the nut 134.

The free end of the leg 114 is pivotally secured to the chair back 106 by pivot means 140 for pivotal movement about an axis parallel to the leg 112 and substantially perpendicular to the chair back 106. The pivot means 140 is also of antifriction type with the bearing housing 142 being fixedly secured to the arm 114.

It will be noted that not only is the pivotal axis of the pivot means disposed so as to be generally perpendicular to the back of a passenger, not shown, seated in the chair 100, but also such axis is disposed to be well above the center of gravity of the combination of the chair 100 and its seated passenger when the chair back 106 is essentially in a vertical plane.

It will also be noted that the intersection of axes of the pivot means 116 and 140 is disposed as to approximately in the position of the upper part of the torso of a passenger and a short distance in front of the upper part of the chair back 106. Inspection of the drawings with particular emphasis on the geometrical relationships pointed out in the last few paragraphs will make it plain that while each passenger unit is free to rock to and fro, both forwards and sideways, such movements are about a stable position in which a passenger is seated more or less erectly, and such movements even when encouraged by bold passengers cannot be of such magnitude of departure from the stable position as to actually endanger the falling of a passenger from the seating unit.

The operation of the ride 10, including the loading and unloading of the passenger units 24 will manifest to those conversant with the art and elaboration thereon is unnecessary.

A brief description of the dismantling procedure will facilitate an appreciation of the mobility of the equipment.

The passenger units 24 can be removed from the wheel 22 as they are moved to the bottom of the wheel 22 when the wheel axis is horizontal. They can be removed in such a sequence as to minimize wheel imbalance. The pivot means 116 affords a convenient disconnect, and on removal, the units 24 can be placed in an auxiliary transport van, not shown.

After the passenger units 24 have been removed, the pivot means 18 is freed and the hydraulic means 20 is actuated to lower the support 16 to the position shown in FIG. 15, the shaft 60 having been left undisturbed. With the support 16 thus lowered, it is then a relatively simple matter for two men to disassemble first the brace rods 90 and then the spokes 84, such rods and spokes being disposed for transport on the bed 14 as indicated at 160.

Attention is now directed to FIGS. 12–14 and 16 illustrative of a modification in the form of the hub and spindle structure, the remaining parts of the ride being the same as previously described except as specially pointed out. The wheel axle 30 has integrally joined thereto the hub 180 and a tapered spindle 182, the free end of the latter being enlarged as indicated at 184. Rather than the inner ends of the spokes being threaded into the hub as in the previously described embodiment, the hub 180 is provided with an annular groove 186 into which is received the flattened inner end portions 188 of the spokes 190. The flattened inner end portion 188 of each spoke 190 is detachably retained in assembled position by a pair of nut and bolt means that extend through aligned openings 194 and 196 in the hub 180 and the spoke 190. The spokes 190 are otherwise identical to the previously described spokes 90.

The brace rods 90 have their radially innermost ends threaded into the radially enlarged end 184 of the spindle 182 in the same manner as in the previously described embodiment of the invention. The radial enlargement 184 of the spindle 182 affords the advantage that the brace rods 90 do not have to come into such close convergence and affords greater tool working room in the assembly and disassembly of the brace rods. It will be seen on comparison of FIGS. 15 and 16 that the brace rod receiving sockets 192 in the enlarged spindle end 184 have a more convenient spacing than the sockets 96 in FIG. 15.

FIG. 16 serves to show the ride 10 in a slightly less advanced stage of disassembly as compared to FIG. 15 in that the spokes 190 have not been removed.

It will be understood that the ride 10 operates the same whether or not it employes the modified hub, spindle and spokes.

Attention is now directed to the appended claims.

I claim:

1. In an amusement ride of the type wherein a rotatable wheel that carries a plurality of passenger carrying units spaced about its periphery is power driven to rotate about its central axis, the improvement comprising a stationary and upstanding ground support having fixed thereto a gimbal means mounting therein an axle to which the wheel is fixedly secured with the axle acting as the central axis of the wheel for enabling both vertical tilting movement of the axle of the wheel between approximately horizontal and vertical positions and simultaneous limited horizontal turning movement of the axle in the gimbal means, said gimbal means including a first controlled power means longitudinally supporting the axle for rotating the axle on its longitudinal axis for driving the wheel to rotate about its axis, said gimbal means being fixed on the support at a vertical height above ground that is greater than is the spacing of passenger units from the axis of the wheel, whereby all the passenger units are relatively elevated when the axis of the wheel is vertical as compared to the lowermost of such units when the axis is horizontal, and a second controlled power means on said support including radially extending means operatively connected to the axle for effecting said simultaneous vertical tilting and horizontal turning movements of said axle of the wheel independently of rotation of the wheel about its axis.

2. The combination of claim 1, wherein said second controlled power means is operatively connected to the axle through the radially extending means to cause the axis of the wheel axle to trace out a conical surface that is symmetrical about a straight line that is inclined at an acute angle to the vertical.

3. The combination of claim 2, wherein the line is inclined to the vertical approximately 45° and wherein the conical surface has an apex angle of approximately 90°.

4. The combination of claim 2, wherein said second controlled power means on said support includes a rotatable power shaft in alignment with said line of symmetry fixed to and for turning said radially extending means.

5. In an amusement ride of the type wherein a wheel that carries a plurality of passenger carrying units spaced about its periphery is mounted for powered rotation about its central axis, the improvement comprising a stationary and upstanding ground support having fixed thereto a gimbal means rotatably mounting therein an axle to which the wheel is fixedly secured with the axis acting as the central axis of the wheel for enabling both vertical tilting movement of the axle of the wheel between approximately horizontal and vertical positions and simultaneous limited horizontal turning movement of the axle in the gimbal means, said gimbal means being fixed to the support at a vertical height above ground that is greater than is the spacing of the passenger units from the axis of the wheel in an arrangement such that the lowermost of the passenger units is spaced above ground when the axle is horizontal, and a single power driven means fixed to the support at a position adjacent the gimbal means and operatively connected to said axle for driving the axle synchronously both to tilt vertically and to turn horizontally through a predetermined cyclic sequence, each of the passenger carrying units comprising a seat adapted to support a passenger seated thereon, and a seat supporting arm pivotally connected for free pivotal movement at spaced positions to both the wheel and the passenger seat, with the pivotal connection of the arm to the wheel being about an arm axis substantially parallel to the axle, and with the pivotal connection of the arm to the seat being about an axis that is substantially perpendicular to the arm axis.

6. In an amusement ride of the type that includes a wheel having a rotatably mounted axle that is coincident with its central axis, means disposed at one side of the wheel for supporting and for tilting said axle between horizontal and vertical positions, and passenger carrying seats supported at spaced positions about the periphery of the wheel, the improvement wherein each of said seats is disposed on the side of the wheel opposite said one side thereof and is supported by means comprising an "L" shaped arm constituted of joined first and second legs having remote opposite ends, said first leg having its end pivoted to the wheel about an arm axis that is parallel to the axle, with said first leg being substantially perpendicular to the arm axis, said second leg extending from the wheel in a direction therefrom opposite said one side thereof and having its end pivotally connected to the seat about a seat axis substantially parallel to said first leg, the arrangement being such that the wheel is above the supporting and tilting means when the axle is vertical, with the seats being then disposed above the wheel.

* * * * *